US010561997B2

(12) United States Patent
Olovsson et al.

(10) Patent No.: US 10,561,997 B2
(45) Date of Patent: Feb. 18, 2020

(54) MIXING UNIT FOR MIXING FLUIDS

(71) Applicant: GE Healthcare Bio-Sciences AB, Uppsala (SE)

(72) Inventors: Bjorn Olovsson, Uppsala (SE); Daniel Carlsson, Stockholm (SE); Mahias Osmark, Stockholm (SE); Magnus Gamberg, Stockholm (SE)

(73) Assignee: GE Healthcare Bio-Sciences AB, Uppsala (SE)

( * ) Notice: Subject to any disclaimer, the term of this patent is extended or adjusted under 35 U.S.C. 154(b) by 0 days.

(21) Appl. No.: 15/521,006

(22) PCT Filed: Oct. 22, 2015

(86) PCT No.: PCT/EP2015/074541
§ 371 (c)(1),
(2) Date: Apr. 21, 2017

(87) PCT Pub. No.: WO2016/062831
PCT Pub. Date: Apr. 28, 2016

(65) Prior Publication Data

US 2017/0333856 A1 Nov. 23, 2017

(30) Foreign Application Priority Data

Oct. 23, 2014 (SE) ..... 1451267

(51) Int. Cl.
*B01F 11/00* (2006.01)
*B01F 15/00* (2006.01)
(Continued)

(52) U.S. Cl.
CPC .... *B01F 11/0017* (2013.01); *B01F 15/00025* (2013.01); *B01F 15/065* (2013.01);
(Continued)

(58) Field of Classification Search
CPC ..... B01F 11/0017; B01F 2015/061; B01F 15/065; B01F 15/00025; B01F 2015/062; B08B 9/0817
(Continued)

(56) References Cited

U.S. PATENT DOCUMENTS 709,461 A 9/1902 Beach
7,132,531 B1 11/2006 Wellings et al.
(Continued)

FOREIGN PATENT DOCUMENTS

CN 103084098 A 5/2013
DE 900318 C 12/1953
(Continued)

OTHER PUBLICATIONS

International Type Search Report issued in connection with corresponding Swedish application No. 1451267-7 dated Apr. 24, 2015.
(Continued)

*Primary Examiner* — Anshu Bhatia
(74) *Attorney, Agent, or Firm* — Eversheds Sutherland (US) LLP

(57) ABSTRACT

A mixing unit (100) for mixing of fluids is disclosed. The mixing unit (100) includes a mixing chamber (102) for holding one or more fluids and a driving assembly (104) operatively engaged to the mixing chamber (102). The driving assembly (104) is configured to oscillate the mixing chamber (102) for mixing the one or more fluids. The mixing chamber (102) of the mixing unit (100) enables better mixing of fluids in a convenient manner. Further less amount of cleaning fluids may be only required for cleaning the mixing chamber (102) after the mixing process. The mixing unit (100) can be used for mixing amino acids with different fluids however this unit can be used for mixing other fluids as well.

18 Claims, 2 Drawing Sheets

(51) Int. Cl.
*B08B 9/08* (2006.01)
*B01F 15/06* (2006.01)

(52) U.S. Cl.
CPC ..... *B08B 9/0817* (2013.01); *B01F 2015/061* (2013.01); *B01F 2015/062* (2013.01)

(58) Field of Classification Search
USPC ..... 366/114
See application file for complete search history.

(56) References Cited

U.S. PATENT DOCUMENTS

| | | | | |
|---|---|---|---|---|
| 7,172,099 | B2 | 2/2007 | Hofte et al. | |
| 8,852,505 | B2 | 10/2014 | Dupoteau et al. | |
| 2005/0265120 | A1* | 12/2005 | Naoe | B01F 3/1221 366/114 |
| 2006/0032607 | A1* | 2/2006 | Wisniewski | B01F 15/065 165/47 |
| 2007/0048185 | A1 | 3/2007 | Dupoteau et al. | |
| 2009/0168590 | A1* | 7/2009 | Koenig | B01F 11/0258 366/114 |
| 2012/0289623 | A1* | 11/2012 | Sumiyoshi | B01F 11/0002 523/351 |

FOREIGN PATENT DOCUMENTS

| | | | |
|---|---|---|---|
| JP | H06-25283 | A | 2/1994 |
| JP | H06-79166 | A | 3/1994 |
| JP | H11-286555 | A | 10/1999 |
| WO | 2012019642 | A1 | 2/2012 |
| WO | 2013080190 | A1 | 6/2013 |
| WO | 2013/187947 | A1 | 12/2013 |
| WO | 2014033297 | A1 | 3/2014 |

OTHER PUBLICATIONS

European Office Action for EP Application No. 15784674.2 dated Oct. 15, 2019 (3 pages).
Chinese Office Action for CN Application No. 201580057491.6 dated Sep. 16, 2019 (13 pages with English translation).
Japanese Office Action for JP Application No. 2017-521542 dated Sep. 19, 2019 (10 pages with English translation).
Xueqin, "Food Factory Machinery and Equipment," China Light Industry Press, 2008, 3 pages.

* cited by examiner

MIXING UNIT FOR MIXING FLUIDS

FIELD OF THE INVENTION

The subject matter disclosed herein relates to mixing of fluids and more particularly to a mixing chamber for mixing one or more fluids.

BACKGROUND OF THE INVENTION

Multiple fluids may be mixed for different applications and in various fields. In an application amino acids may be mixed with different fluids. The fluids may be maintained in a cooled state by precooling the fluids. The fluids and amino acids are usually mixed in a mixing unit. Initially the fluids may be poured into the mixing unit and an impeller may be used to facilitate the mixing. The impeller is usually positioned at the bottom of a chamber of the mixing unit. The impeller may have a fan structure that may be operated by a motor. The impeller motion i.e. rotational motion can be used for cleaning the chamber as well. In order to clean the chamber a small quantity of cleaning fluid may be poured into the chamber. The amount of cleaning fluid required may be based on a volume and size of the chamber. The impeller is then operated to circulate the cleaning fluid within the chamber for cleaning. The impeller is magnetically driven by a rotating magnet present in a bottom plate of the chamber. Such arrangements are complex and also for cleaning the mixing chamber more amount of cleaning fluid may be required so as to cover the entire internal walls of the chamber.

One of the applications may be for polypeptide synthesis. Peptides are short chains of amino acid monomers linked by peptide or amide bonds. In this synthesis process multiple amino acids along with chemical solutions may be used. The amino acids in an organic solvent need to be separated from air humidity as they are sensitive to moisture. Multiple amino acids may be poured into the mixing unit and mixed to activate them to form polypeptide chains. Typically 20 or more different amino acids and other chemical solutions may be poured into the mixing unit for a single polypeptide synthesizing run. Several synthesis technologies are available for polypeptide manufacturing. The quantities required, length of the peptide and its complexity influences the selection.

Accordingly, a need exists for an improved mixing unit that can be used for mixing of fluids. Moreover the chamber of the mixing unit also needs to be conveniently cleaned using cleaning fluids.

SUMMARY OF THE INVENTION

The object of the invention is to provide an improved mixing unit that can be used for mixing of fluids, which overcomes one or more drawbacks of the prior art. This is achieved by a mixing unit having a mixing chamber that can be rotated for mixing fluids as defined in the independent claim.

One advantage with the disclosed invention is that a mixing chamber of the mixing unit enables better mixing of fluids in a convenient manner. Further less amount of cleaning fluids may be only required for cleaning the mixing chamber after the mixing process. The mixing unit can be used for mixing amino acids with different fluids, however this unit can be used for mixing other fluids as well.

In an embodiment a mixing unit for mixing of fluids is disclosed. The mixing unit includes a mixing chamber for holding one or more fluids and a driving assembly operatively engaged to the mixing chamber. The driving assembly is configured to oscillate the mixing chamber for mixing the one or more fluids.

In another embodiment a method of stirring one or more fluids in a mixing unit is disclosed. The method involves supplying one or more fluids in the mixing unit. The mixing unit comprises a mixing chamber for holding the one or more fluids, and a driving assembly operatively engaged to the mixing chamber. The mixing chamber is then oscillated using the driving assembly for stirring the one or more fluids.

A more complete understanding of the present invention, as well as further features and advantages thereof, will be obtained by reference to the following detailed description and drawings.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical and other changes may be made without departing from the scope of the embodiments. The following detailed description is, therefore, not to be taken as limiting the scope of the invention.

As discussed in detail below, embodiments of the invention including a mixing unit for mixing of fluids is disclosed. The mixing unit includes a mixing chamber for holding one or more fluids and a driving assembly operatively engaged to the mixing chamber. The driving assembly is configured to oscillate the mixing chamber for mixing the one or more fluids.

Figure 1:
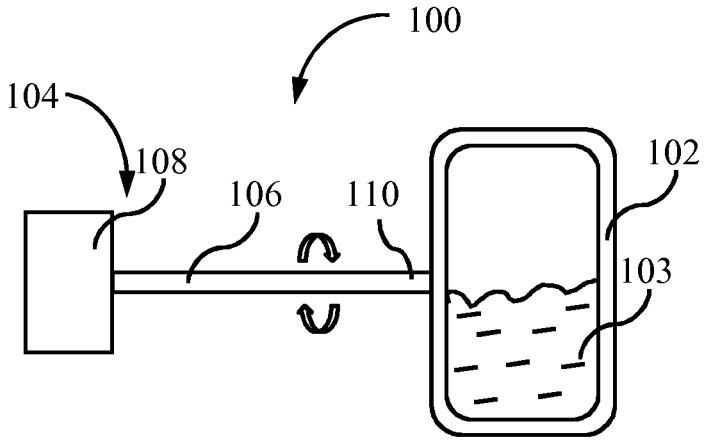
FIG. 1 is a schematic representation of a mixing unit for mixing one or more fluids according to an embodiment.

FIG. 1 is a schematic representation of a mixing unit 100 for mixing one or more fluids according to an embodiment. The fluids may be viscous fluids for instance mixing epoxy resin with liquid catalyst. Another example may be mixing amino acids with different fluids for pre-activation in a polypeptide synthesis process. The mixing unit 100 needs to keep the fluids in at constant temperature during activation. The mixing unit 100 includes a mixing chamber 102 that can hold the one or more fluids 103 (hereinafter referred to as 'fluids'). The fluids may include but not limited to different amino acids, chemical solutions and organic solvents. The amino acids may be for example glutamic acid, lysine, carboxylic acid, gamma-amino-butyric acid, glycine and alanine. Even though only few amino acids are enumerated other amino acids may be also used. Further an inert gas may be also supplied into the mixing chamber 102. Even though not shown in FIG. 1, a gas valve may be connected to the mixing chamber 102 for supplying the inert gas. The inert gas may be moisture free. In an embodiment the mixing chamber 102 may be maintained in a pressurized environment. This is achieved by connecting the mixing chamber 102 to a gas inlet and distributing the inert gas into the mixing chamber 102. The flow of the inert gas may be controlled using a control valve connected to the gas inlet. In certain embodiments the inert gas may be nitrogen. In other embodiments coupling agents may be also added along with the fluids which enable the amino acids to bind with each other. The mixing chamber 102 is operatively engaged to a driving assembly 104. The driving assembly 104 is configured to oscillate the mixing chamber 102 so that the fluids (i.e. the amino acids, chemical solutions and organic solvents) are stirred to be mixed together. Prior to use, the mixing chamber 102 may be washed using solvents such as but not limited to N-Methylpyrrolidone (NMP) and dimethylformamide (DMF) so as to wash away any amino acids of previous peptides. Some de-protective agent for example piperidine may be also added along with the solvents.

In an embodiment the driving assembly 104 may include an axle 106 operatively connected to the mixing chamber 102 and a motor unit 108. The axle 106 may have an end 110 connected to the mixing chamber 102 and a second end 112 connected to the motor unit 108. The motor unit 108 functions to rotate the axle 106 thereby rotating the mixing chamber 102. The fluids are agitated in the mixing chamber 102 vigorously to get mixed. The mixing chamber 102 may be rotated in a predefined frequency and predefined amplitude that facilitates efficient mixing of the fluids 103. The predefined frequency and the predefined amplitude may be based on quantity of fluids present in the mixing chamber 102 and size of the mixing chamber 102. In this case the mixing chamber 102 may have a preset position and then may be rotated from the preset position at a predefined angle in one direction and at a predefined angle in the opposite direction. Even though the driving assembly 104 is described herein to rotate the mixing chamber 102, different ways of oscillating the mixing chamber 102 for mixing the fluids 103 are within the scope of this disclosure. In an embodiment the driving assembly 104 may rotate the mixing chamber 102 at an angle around +/−45 degrees and frequency of approximately 0.5 Hz for stirring the fluids. The fluids 103 i.e. amino acids may need to be mixed for approximately 2 hours for the pre-activation to be completed. For example during the mixing process the fluids such as amino acids (in solution form) are pre-activated for coupling against each other to form peptide chains in a column. Then an additive and base may be added along with a coupling reagent into the column for facilitating the coupling. The additive and base and the coupling reagent depends on the type of amino acid added. In an embodiment the coupling reagent or more coupling mixtures may be added for the amino acid to bind with the already existing peptide chains.

Once the fluids are mixed they can be removed, and then a cleaning fluid may be added into the mixing chamber 102. The mixing chamber 102 may be then rotated so that the cleaning fluid is stirred within the mixing chamber 102 touching all its walls for cleaning. The cleaning fluid may be as discussed earlier for instance NMP and DMF so as to wash away any amino acids of previous peptides. The mixing chamber 102 is rotated using the driving assembly 104 at a predefined frequency and predefined amplitude so that the cleaning fluid flows through all the internal walls of the mixing chamber 102. The cleaning fluid is used to wash the internal walls to remove any leftover fluids that were mixed in the mixing chamber 102. For instance the mixing chamber may be rotated at higher amplitude as compared to amplitude of rotation during mixing of the fluids. Moreover a predefined level of pressure is maintained in the mixing chamber 102 to ensure that no leakage into the mixing chamber 102 occurs. In an embodiment the mixing chamber 102 may be rotated at an angle +/−180 degrees and a frequency of approximately 0.5 Hz.

Figure 2:
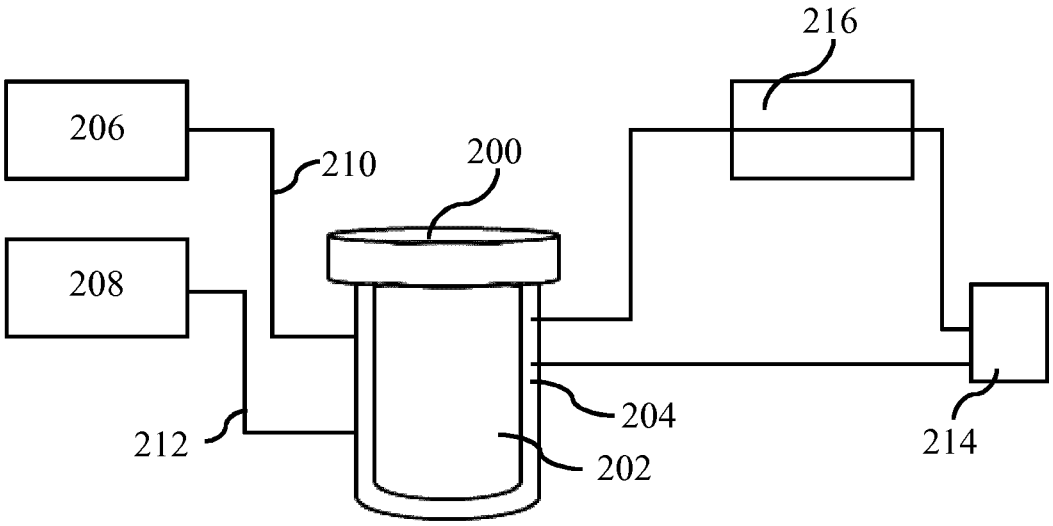
FIG. 2 illustrates a mixing unit for mixing fluids according to an exemplary embodiment.

FIG. 2 illustrates a mixing unit 200 for mixing fluids according to an exemplary embodiment. The mixing unit 200 includes a compartment 202 for holding the fluids and an outer compartment 204 surrounding the compartment 202. The outer compartment 204 carries a cooling fluid for cooling the fluids. The cooling fluid pre-cools the fluids before pre-activation. As shown in FIG. 2, supply tanks 206 and 208 are provided and connected to the mixing unit 200 for supplying the fluids into the compartment 202. Tubes 210 and 212 may be used for connecting the supply tanks 206 and 208 to the mixing unit 200 respectively. The mixing unit 200 is agitated or rotated using a driving assembly (not shown in FIG. 2) similar to the driving assembly 104 for mixing the fluids. The fluids may need to be cooled intermittently for which the cooling fluid is provided to flow through the outer compartment 204. The cooling fluid is supplied from a supply tank 214. The cooling fluid passes through a heat exchanger 216 wherein the fluid is cooled to obtain the cooling fluid. The cooling fluid is then passed into the compartment 204 from the heat exchanger 216. A pump (not shown in FIG. 2) may be used to pump the fluid into the heat exchanger 216 from the supply tank 214. In an embodiment another pump (not shown in FIG. 2) may be also provided to pump the fluid from the heat exchanger 216 into the compartment 204 for cooling the fluids in the compartment 202.

The heat exchanger 216 may include coolants for cooling the fluid. In an embodiment the heat exchanger 216 may be filled with a coolant and the fluid from the supply tank 214 may flow through a pipe arranged to pass through the heat exchanger 216. While the fluid passes through the pipe due to heat transfer the fluid gets cooled. The cooled fluid enters the compartment 204 and then recirculated into the supply tank 214 after cooling the fluids in the compartment 202. The fluid that reached the supply tank 214 may be recirculated into the heat exchanger 216 for further cooling. It may be noted that FIG. 2 describes an exemplary arrangement for cooling the fluids however it may be envisioned that other exemplary arrangements for cooling the fluids can be embodied within the scope of this disclosure.

Figure 3:
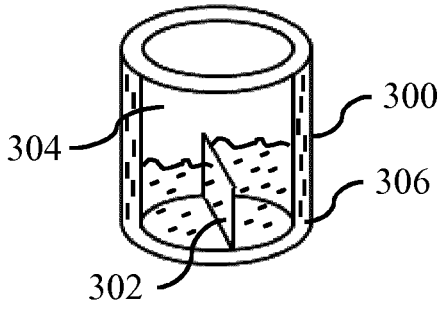
FIG. 3 illustrates a mixing unit including a separating member for separating two or more fluids according to an exemplary embodiment.

FIG. 3 illustrates a mixing unit 300 including separating member 302 for separating two or more fluids according to an exemplary embodiment. The separating member 302 may be complete wall formed within the mixing unit 300 for forming two compartments such as a compartment 304 and a compartment 306. The compartment 304 may hold one or more fluids and the compartment 306 may hold one or more another fluids. The fluids in the compartment 304 do not interact or mix with the fluids in the compartment 306 even when the mixing unit 300 is rotated to limited amplitude. A cooling fluid may pass through an outer compartment of the mixing unit 300 for cooling the fluids in both these compartments.

Figure 4:
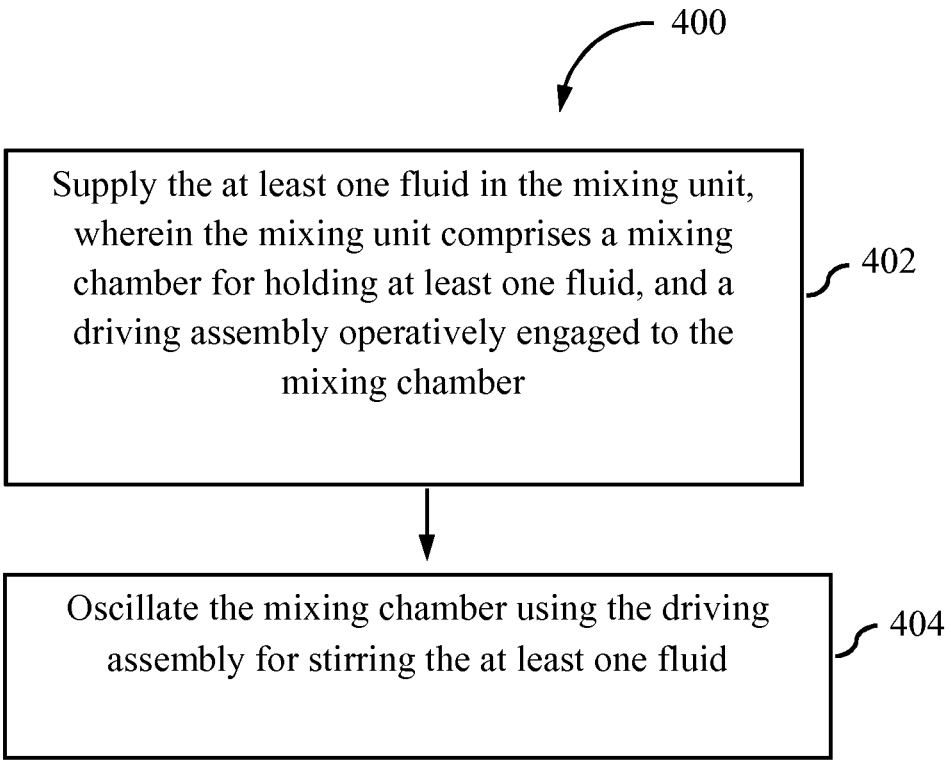
FIG. 4 illustrates a method of stirring one or more fluids in a mixing unit according to an embodiment.

FIG. 4 illustrates a method 400 of stirring one or more fluids in a mixing unit according to an embodiment. Initially the fluids are supplied into the mixing unit at step 402. The mixing unit as described in conjunction with FIGS. 1-3, includes a mixing chamber that can hold the one or more fluids (hereinafter referred to as 'fluids'). The fluids may include but not limited to different amino acids, chemical solutions and organic solvents. The amino acids may be for example glutamic acid, lysine, carboxylic acid, gamma-amino-butyric acid, glycine and alanine. Even though only few amino acids are enumerated other amino acids may be also used. The mixing chamber is operatively engaged to a driving assembly. The driving assembly is configured to oscillate the mixing chamber so that the fluids are stirred to be mixed together at step 404. The mixing chamber may be rotated in a predefined frequency and predefined amplitude that facilitates efficient mixing of the fluids. The predefined frequency and the predefined amplitude may be based on quantity of fluids present in the mixing chamber and size of the mixing chamber. In an embodiment the mixing chamber may be rotated at an angle +180° and −180°. In this case the mixing chamber may have a preset position and then may be rotated from the preset position at 180° in one direction and at 180° in the opposite direction. Even though the driving assembly is described herein to rotate the mixing chamber, different ways of oscillating the mixing chamber for mixing the fluids are within the scope of this disclosure.

Once the fluids are mixed they can be removed, and then a cleaning fluid may be added into the mixing chamber. The fluids may be mixed for at least 2 hours. The mixing chamber may be then rotated so that the cleaning fluid is stirred within the mixing chamber touching all its walls for cleaning. The mixing chamber is rotated in a same manner using the driving assembly at a predefined frequency and predefined amplitude so that the cleaning fluid flows through all the internal walls of the mixing chamber. The cleaning fluid is used to wash the internal walls to remove any leftover fluids that were mixed in the mixing chamber. For instance the mixing chamber may be rotated at higher amplitude as compared to amplitude of rotation during mixing of the fluids. Moreover a predefined level of pressure is maintained in the mixing chamber 102 to ensure that no leakage into the mixing chamber 102 occurs. In an embodiment the mixing chamber 102 may be rotated at an angle +/−180 degrees and a frequency of approximately 0.5 Hz.

In an embodiment the mixing unit includes a compartment for holding the fluids and an outer compartment surrounding the compartment. The outer compartment carries a cooling fluid for cooling the fluids. Moreover in an embodiment supply tanks may be provided and connected to the mixing unit for supplying the fluids into the compartment. Further tubes may be used for connecting the supply tanks to the mixing unit. The mixing unit is agitated or rotated using a driving assembly similar to the driving assembly for mixing the fluids.

From the foregoing, it will appreciate that the above disclosed mixing unit for mixing one or more fluids provide numerous benefits, such as an improved way of mixing the fluids in an efficient and an effortless manner. The mixing unit enables the fluids to be mixed properly and evenly. Further for cleaning the mixing unit only a small amount of cleaning fluid is added into a mixing chamber of the mixing unit. The frequency and amplitude of rotation of the mixing unit facilitates the cleaning fluid to efficiently clean the inner surface of the mixing chamber. The same amount of cleaning fluid can be used to clean different amounts of fluids mixed in the mixing chamber.

This written description uses examples to disclose the invention, including the best mode, and also to enable any person skilled in the art to practice the invention, including making and using any computing system or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. A mixing unit for mixing fluids, the mixing unit comprising:

a mixing chamber comprising a first compartment and a second compartment arranged adjacent to the first compartment, wherein the first compartment is configured to hold at least one fluid, and wherein the second compartment is configured to hold a cooling fluid;

a driving assembly operatively engaged to the mixing chamber, wherein the driving assembly is configured to oscillate the mixing chamber for mixing the at least one fluid;

at least one fluid supply unit configured to supply the at least one fluid into the first compartment;

a cooling unit configured to supply the cooling fluid into the second compartment; and a gas supply unit configured to supply an inert gas into the first compartment.

2. The mixing unit of claim 1, wherein the second compartment surrounds the first compartment.

3. The mixing unit of claim 1, wherein the driving assembly is configured to oscillate the mixing chamber at a predefined frequency and a predefined amplitude for mixing the at least one fluid.

4. The mixing unit of claim 1, wherein the driving assembly is configured to oscillate the mixing chamber by rotating the mixing chamber.

5. The mixing unit of claim 4, wherein the driving assembly is configured to rotate the mixing chamber by 180°.

6. The mixing unit of claim 1, wherein the driving assembly comprises:

an axle operatively connected to the mixing chamber; and a driving unit operatively connected to the axle, wherein the driving unit is configured to drive the axle for oscillating the mixing chamber.

7. The mixing unit of claim 1, wherein the at least one fluid comprises a cleaning fluid, and wherein the driving assembly is configured to oscillate the mixing chamber at a predefined frequency and a predefined amplitude for cleaning the mixing chamber using the cleaning fluid.

8. The mixing unit of claim 6, wherein the driving unit comprises a motor configured to rotate the axle, and wherein the axle is configured to rotate the mixing chamber.

9. The mixing unit of claim 1, further comprising at least one fluid outlet unit configured to pump the at least one fluid out from the mixing chamber.

10. The mixing unit of claim 1, wherein the at least one fluid comprises at least one amino acid.

11. The mixing unit of claim 1, wherein the driving assembly is configured to rotate the mixing chamber in a first direction from a preset position to a first position and to rotate the mixing chamber in an opposite second direction from the first position to a second position.

12. The mixing unit of claim 11, wherein the first position is at a predefined angle relative to the preset position, and wherein the second position is at the predefined angle relative to the preset position.

13. The mixing unit of claim 1, wherein the gas supply unit is configured to maintain a pressurized environment in the first compartment.

14. A method for mixing fluids using the mixing unit of claim 1, the method comprising:

supplying, via the at least one fluid supply unit, the at least one fluid into the first compartment;

supplying, via the cooling unit, the cooling fluid into the second compartment;

oscillating, via the driving assembly, the mixing chamber for mixing the at least one fluid; and supplying, via a gas supply unit, an inert gas into the first compartment to maintain a pressurized environment in the first compartment.

15. The method of claim 14, wherein the at least one fluid comprises at least one amino acid.

16. The method of claim 14, wherein supplying the cooling fluid into the second compartment comprises maintaining the at least one fluid at a constant temperature.

17. The method of claim 14, wherein oscillating the mixing chamber for mixing the at least one fluid comprises rotating the mixing chamber.

18. A mixing unit for mixing fluids, the mixing unit comprising:

a mixing chamber comprising a first compartment and a second compartment arranged adjacent to the first compartment, wherein the first compartment is configured to hold at least one fluid, and wherein the second compartment is configured to hold a cooling fluid;

a driving assembly operatively engaged to the mixing chamber, wherein the driving assembly is configured to oscillate the mixing chamber for mixing the at least one fluid;

at least one fluid supply unit configured to supply the at least one fluid into the first compartment;

a cooling unit configured to supply the cooling fluid into the second compartment; and a heat exchanger positioned between the cooling unit and the second compartment, wherein the heat exchanger is configured to cool the cooling fluid.

* * * * *